US011774193B2

(12) United States Patent
Maquin et al.

(10) Patent No.: US 11,774,193 B2
(45) Date of Patent: Oct. 3, 2023

(54) HEADER OF A HEAT EXCHANGER PROVIDED WITH A MEMBER FOR RETENTION AND/OR ANGULAR POSITIONING OF A DEVICE FOR DISTRIBUTION OF A REFRIGERANT FLUID

(71) Applicant: Valeo Systemes Thermiques, Le Mesnil-Saint-Denis (FR)

(72) Inventors: Olivier Maquin, Reims (FR); Jérôme Mougnier, Le Mesnil Saint Denis (FR); Julien Tissot, Le Mesnil Saint Denis (FR); Jérémy Blandin, Le Mesnil Saint Denis (FR); Kamel Azzouz, Le Mesnil Saint Denis (FR); Patrick Leblay, Le Mesnil Saint Denis (FR)

(73) Assignee: Valeo Systemes Thermiques, Le Mesnil-Saint-Denis (FR)

( * ) Notice: Subject to any disclaimer, the term of this patent is extended or adjusted under 35 U.S.C. 154(b) by 83 days.

(21) Appl. No.: 16/771,807

(22) PCT Filed: Dec. 17, 2018

(86) PCT No.: PCT/EP2018/085288
§ 371 (c)(1),
(2) Date: Jun. 11, 2020

(87) PCT Pub. No.: WO2019/121557
PCT Pub. Date: Jun. 27, 2019

(65) Prior Publication Data

US 2021/0071966 A1 Mar. 11, 2021

(30) Foreign Application Priority Data

Dec. 19, 2017 (FR) ..... 1762506

(51) Int. Cl.
*F28F 9/02* (2006.01)
*F28D 1/053* (2006.01)
(Continued)

(52) U.S. Cl.
CPC ..... *F28F 9/0273* (2013.01); *F28F 9/0224* (2013.01); *F28D 1/05391* (2013.01);
(Continued)

(58) Field of Classification Search
CPC ..... F28F 9/0224; F28F 9/0246; F28F 9/0273; F28F 2220/00; F28D 1/05391; F28D 2021/008
See application file for complete search history.

(56) References Cited

U.S. PATENT DOCUMENTS 2,587,720 A * 3/1952 Fritzberg ..... F28D 1/047 165/172
5,782,293 A * 7/1998 Sather ..... F28B 1/06 165/110
(Continued)

FOREIGN PATENT DOCUMENTS

CN 104075496 A 10/2014
DE 19719257 A1 11/1998
(Continued)

OTHER PUBLICATIONS

International Search Report and Written Opinion in corresponding International Application No. PCT/EP2018/085288, dated Mar. 14, 2019 (9 pages).
(Continued)

*Primary Examiner* — Devon Russell
(74) *Attorney, Agent, or Firm* — Osha Bergman Watanabe & Burton LLP

(57) ABSTRACT

The invention concerns a header (4) for a heat exchanger adapted to have a refrigerant fluid (FR) passed through it and
(Continued)

comprising a wall (4*a*-4*d*) delimiting a chamber (6) accommodating a device (7) for distribution of the refrigerant fluid (FR) inside the chamber (6), the distribution device (7) comprising at least one conduit (8*a*, 8*b*) extending between two ends (20*a*, 20*b*; 29*a*, 29*b*) along a longitudinal axis (A1), at least a first end (20*a*) of the conduit (8*a*) being provided with an inlet opening (10) for the admission of the refrigerant fluid (FR) to the interior of the distribution device (7), the distribution device (7) being provided with at least one orifice (11) oriented transversely to the longitudinal axis (A1) for the evacuation of the refrigerant fluid (FR) from the distribution device (7) to the chamber (6), characterized in that it comprises at least one member (17*a*, 17*b*) for retaining the distribution device (7) inside the chamber (6) at least in part made in one piece with the wall (4*a*-4*d*) of the header (4).

10 Claims, 4 Drawing Sheets

(51) Int. Cl.
*F28D 21/00* (2006.01)
*F28F 9/16* (2006.01)

(52) U.S. Cl.
CPC ..... *F28D 2021/008* (2013.01); *F28F 9/0246* (2013.01); *F28F 9/165* (2013.01); *F28F 2220/00* (2013.01); *F28F 2225/08* (2013.01); *F28F 2275/04* (2013.01)

(56) References Cited

U.S. PATENT DOCUMENTS

| | | | | |
|---|---|---|---|---|
| 6,729,386 | B1 * | 5/2004 | Sather | F28D 1/05316 165/110 |
| 8,235,099 | B2 * | 8/2012 | Higashiyama | F28D 1/05391 165/174 |
| 9,448,016 | B2 * | 9/2016 | Wang | F28F 1/42 |
| 2009/0173483 | A1 * | 7/2009 | Beamer | F28F 9/0246 165/173 |
| 2010/0300667 | A1 | 12/2010 | Samuelson | |

FOREIGN PATENT DOCUMENTS

| | | | |
|---|---|---|---|
| EP | 2392886 | A2 | 12/2011 |
| EP | 2869018 | A1 | 5/2015 |
| WO | 2008060270 | A1 | 5/2008 |

OTHER PUBLICATIONS

The Second Office Action issued in Chinese Application No. 201880079879.X, dated Apr. 6, 2022 (16 pages).

* cited by examiner

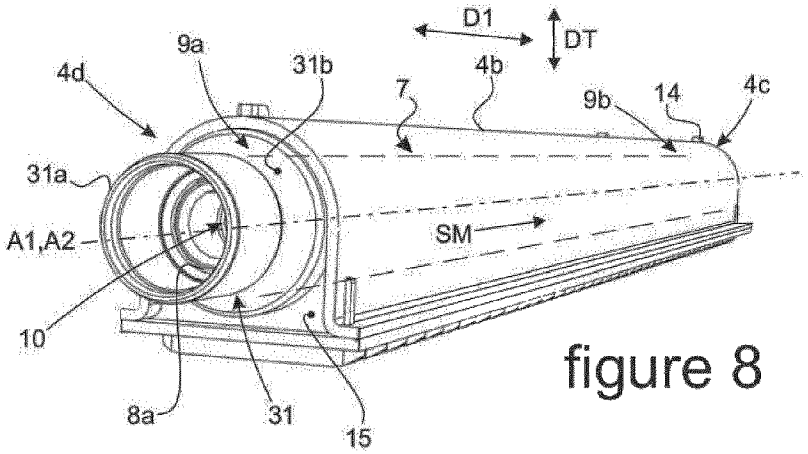
figure 8
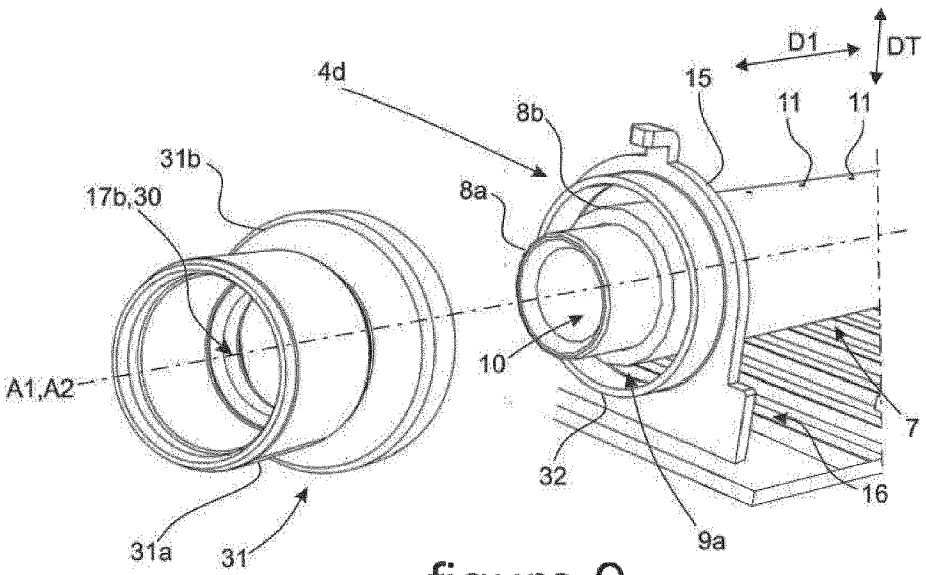
figure 9
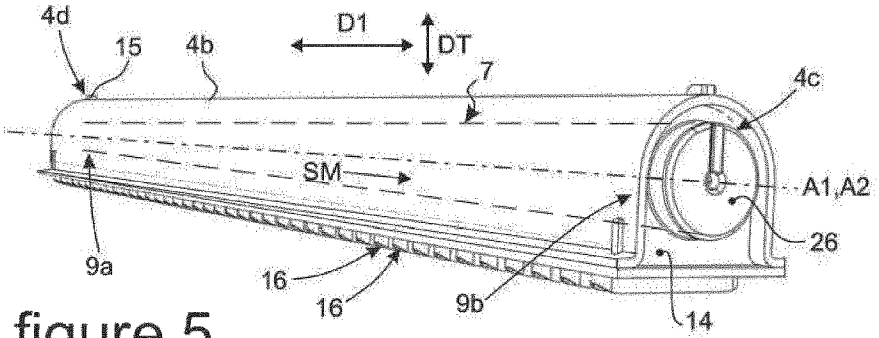
figure 5
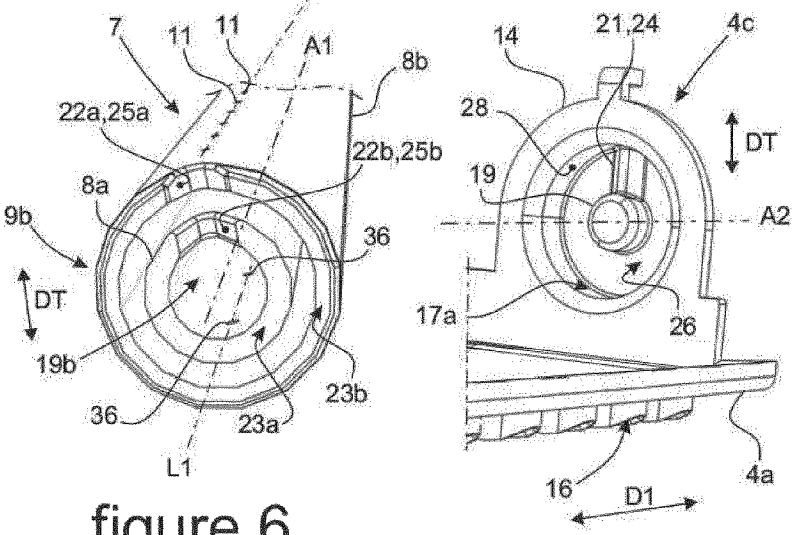
figure 7
figure 6

HEADER OF A HEAT EXCHANGER PROVIDED WITH A MEMBER FOR RETENTION AND/OR ANGULAR POSITIONING OF A DEVICE FOR DISTRIBUTION OF A REFRIGERANT FLUID

The field of the present invention is that of the heat exchangers equipping air conditioning installations for vehicles, notably motor vehicles. The invention concerns a refrigerant fluid header that a heat exchanger of this kind comprises and that accommodates a device for distribution of the refrigerant fluid inside the header. The invention relates more specifically to ways of mounting the distribution device inside the header.

A vehicle is routinely equipped with an air conditioning installation for thermal treatment of the air present in or fed into the passenger compartment of the vehicle. An installation of this kind comprises a closed circuit inside which a refrigerant fluid circulates. The circuit essentially comprises in succession in the direction of circulation of the refrigerant fluid through it a compressor, a condenser, an expander and at least one heat exchanger.

The heat exchanger routinely includes a bundle of tubes disposed between a header and a return box for the refrigerant fluid. The refrigerant fluid is admitted to the interior of the header, circulates along successive paths in the tubes of the bundle between the header and the return box, and is then evacuated from the heat exchanger.

The heat exchanger is for example an evaporator bringing about an exchange of heat between the refrigerant fluid and a flow of air through it. In this case, the refrigerant fluid circulates inside the tubes of the bundle and the flow of air circulates along the tubes of the bundle to cool them.

It is known to accommodate inside the header a device for distribution of the refrigerant fluid comprising a conduit provided with a plurality of orifices. The liquid phase refrigerant fluid is therefore sprayed through the orifices in the form of droplets over the entirety of the length of the conduit, as is clear from the document EP2392886A2.

A general technical problem resides in the industrial implementation of a concept of this kind. In particular, the ways of positioning and/or mounting and/or fixing the distribution device in the header are not addressed. The positioning of the distribution device inside the header is more particularly decisive to achieving a homogeneous feeding with refrigerant fluid of the tubes that the heat exchanger comprises, in order to improve its performance.

The performance required of the heat exchanger must not impede its industrial fabrication, in particular in terms of costs. Another technical problem that arises therefore resides in the ways of mounting and/or positioning the distribution device inside the header making it possible to improve the performance of the heat exchanger by limiting the costs incurred to obtain such performance.

One object of one aspect of the present invention is a header for a heat exchanger equipped with a device for distribution of a refrigerant fluid inside the header. Another object of the invention is a heat exchanger equipped with a header according to the invention.

One aim of the invention is to propose ways of positioning the distribution device inside the header enabling optimization of the performance obtained from the heat exchanger, notably by improving the homogeneity of the temperature of the heat exchanger in service and finally its efficiency.

A more particular aim is to guarantee that rigorous and reliable positioning of the distribution device inside the header is achieved, such as to bring about homogeneous distribution of the refrigerant fluid to each of the tubes of a bundle of tubes that the heat exchanger comprises and that are to be fed with refrigerant fluid from the header.

Another aim of the invention is to propose a embodiment of the distribution device and/or the header enabling easy assembly therebetween, avoiding excessive complication of their structure and/or ways for fixing them to one another, and without affecting the reliability of the positioning required between the distribution device and the header.

Another aim of the invention is to propose a header of this kind and/or a heat exchanger of this kind that can be produced industrially at lower cost.

The header according to one aspect of the invention is a header for a heat exchanger adapted to have a refrigerant fluid passed through it and comprising a wall delimiting a chamber accommodating a device for distribution of the refrigerant fluid inside the chamber. The distribution device comprises at least one conduit extending between two ends along a longitudinal axis, at least a first end of the conduit being provided with an inlet opening for the admission of the refrigerant fluid to the interior of the distribution device. The distribution device is provided with at least one orifice oriented transversely to the longitudinal axis for the evacuation of the refrigerant fluid from the distribution device to the chamber. A header of this kind is innovative in that it comprises at least one member for retaining the distribution device inside the chamber at least in part made in one piece with the wall of the header.

In other words, the distribution device extends inside the header along the longitudinal axis, between a first longitudinal end of the distribution device provided with the inlet opening and a second longitudinal end of the distribution device opposite its first longitudinal end along the longitudinal axis. A participating conduit of the distribution device is provided with the inlet opening for the admission of the refrigerant fluid to the interior of the distribution device. The refrigerant fluid can then be evacuated from the distribution device via said at least one orifice, in particular a plurality of orifices, for its distribution to the chamber delimited by the wall of the header.

The retaining member is notably configured to retain the distribution device inside the chamber in a particular position transverse to the longitudinal axis. A position of this kind can be a central position of the distribution device in the chamber, in such a manner as to guarantee sufficient room around the orifice for the evacuation of the refrigerant fluid. In a case of this kind, the retaining member is a member for centring the distribution device inside the chamber. The distribution device is therefore rigorously positioned inside the chamber, via at least one of its longitudinal ends and by fixing, notably by welding the latter to the wall of the header.

The distribution device is for example installed inside the chamber and coaxial with a transversely median longitudinal axis along which the header extends.

The header may comprise at least one member for angular positioning of the distribution device inside the chamber at least in part made in one piece with the wall of the header.

The angular positioning member determines the angular position of the orifice or orifices around the longitudinal axis of the distribution device, notably positioning those orifices in an angular sector opposite that in which a bundle of the heat exchanger intended to receive the header can extend. The formation of the angular positioning member on the wall of the header is advantageously carried out conjointly with the formation of the retaining member on the wall of the header.

The expression "made in piece with" means that the retaining member and/or the angular positioning member is or are produced conjointly with the formation of at least one wall element that the wall of the header comprises. Accordingly, the retaining member and/or the angular positioning member and the wall of the header form a monolithic assembly, the wall incorporating the retaining member and/or the angular positioning member.

For example, the integration of the retaining member and/or the angular positioning member into the wall of the header may be effected by shaping a metal plate constituting part of the wall element, e.g. by drawing, to form for example a flange incorporating the retaining member.

According to one embodiment, a retaining member and an angular positioning member are formed with the wall of the header via at least one common wall element that it comprises and that is disposed at one or both longitudinal ends of the distribution device. Accordingly, the retaining member and the angular positioning member can be formed conjointly on the wall element, notably during its shaping by drawing, for example.

According to diverse variants:

- a retaining member and/or an angular positioning member may be formed with the wall of the header at the same longitudinal end of the distribution device,
- a retaining member may also be formed with the wall of the header at one of the longitudinal ends of the distribution device and an angular positioning member may be formed with the wall of the header at the other longitudinal end of the distribution device.

The rigorous positioning of the distribution device in the chamber as much regards its retention as its angular positioning can therefore be achieved without impeding easy and rapid mounting thereof in the chamber by an operative. In fact, the distribution device can be threaded axially into the chamber in a longitudinal direction in which the header extends, without impeding its cooperation with the retaining member and/or with the angular positioning member.

The distribution device can be axial threaded along the longitudinal axis by longitudinally sliding the conduit inside the chamber until it comes to cooperate with at least one retaining member and/or one angular positioning member formed with the wall of the header. Following such sliding, the distribution device is then centred and/or angularly positioned via at least its second longitudinal end.

Moreover, the header and the distribution device may be conjointly fastened together in a single welding operation. More particularly, the components of the distribution device and the components of the header are advantageously welded in a common welding operation, notably by brazing in a furnace. This makes it possible to avoid a specific operation of welding the distribution device to the wall of the header, with the advantage of reducing the production costs of the heat exchanger.

The retaining member and/or the angular positioning member may notably be made in one piece with at least one wall element of the header delimiting the chamber that is transverse to the longitudinal direction of the header. The transverse wall element is oriented transversely to the longitudinal axis and/or to the longitudinal direction of the header.

A transverse wall element of this kind may have a simple structure, for example being configured as a flange integrating at least one retaining member and/or at least one angular positioning member that are made in one piece with the shaped flange, which is notably shaped by drawing.

According to one embodiment, the wall of the header comprises at least one cover that extends along a longitudinal axis and at least one flange oriented transversely to the longitudinal axis and disposed at a longitudinal end of the cover, and the retaining member and/or the angular positioning member is at least in part made in one piece with the flange.

The wall of the header may equally comprise a header plate provided with openings to receive tubes to be fed with refrigerant fluid, the cover covering the header plate and the flange extending transversely to the longitudinal axis and being disposed between the cover and the header plate and in contact with both the latter.

The flange notably forms a transverse wall element of the header, which delimits the chamber at one longitudinal end of the header.

The wall of the header may comprise two flanges delimiting the chamber between them in the longitudinal direction in which the header extends. Such flanges then extend transversely to the longitudinal direction of the header between the cover and the header plate.

The openings that the header plate includes are for example configured as slots that receive the tubes of a bundle of tubes that the heat exchanger comprises and that are to be fed with refrigerant fluid from the header.

According to one embodiment, the flange forms a plug for closing the distribution device at one longitudinal end of the conduit, termed the second end, opposite the first end of the conduit along the longitudinal axis, that is to say that through which the refrigerant fluid is able to enter into the distribution device. The flange therefore plugs the conduit. According to one embodiment, the retaining member comprises at least one finger made in one piece with the wall of the header, notably the flange, and an opening delimited by the conduit, the finger being accommodated in the opening.

The opening of the conduit is the one that is delimited by its wall and that extends between its ends along its longitudinal axis. The refrigerant fluid admitted to the interior of the conduit can pass through this opening prior to its evacuation from the conduit through the orifice or orifices.

The retaining member comprises at least one first bearing supporting the first end of the distribution device. The distribution device is therefore retained on the wall of the header at each of its ends via two retaining members one formed by the finger and the other by the first bearing, the latter having the distribution device passed through it.

The first bearing is notably formed by a transverse wall element that the wall of the header comprises, being for example formed of a sleeve welded to the wall of the header. The sleeve is notably welded to a transverse wall element of the header disposed at the first end of the distribution device. The sleeve is configured to allow the distribution device to slide inside the chamber, during its installation on the wall of the header.

According to one embodiment, the angular positioning member comprises at least two portions of complementary shape to one another, a first portion made in one piece with the wall of the header cooperating by nesting with a second portion formed in an end face at one of the longitudinal ends of the conduit. It can for example be the second end of the conduit that comprises the end face envisaged here. The first portion and the second portion notably extend in a direction transverse to the longitudinal axis and/or to the longitudinal direction of the header.

The first portion and the second portion are for exampled formed at least by a rib accommodated in at least one notch. The rib or the notch is interchangeably formed one on the wall of the header, notably the flange, and the other on the distribution device, for example the conduit thereof. Accordingly, the rib may be made in one piece with the wall of the header, whereas the notch is formed in the end face at the second end of the conduit. Alternatively, the notch may be formed in the wall of the header, whereas the rib is made in one piece with the end face at the second end of the conduit.

The distribution device can therefore be angularly positioned on the wall of the header in a reliable manner at only one of the longitudinal ends of the distribution device, by a single rib cooperating with a single notch. The rib is for example integral with the first flange, which then includes the finger and the rib, the notch being formed on the end face at the second end of at least one conduit that the distribution device comprises.

The distribution device may be threaded inside the second flange through the first bearing that it comprises, starting from its second end. The distribution device can then be pushed axially across the chamber, sliding against the first bearing in the longitudinal direction of the header, until the finger is introduced into the opening of the conduit and the rib is introduced into the notch.

According to one embodiment, the orifice or orifices is or are oriented in one or more directions transverse to the longitudinal axis. A plurality of orifices are distributed along the conduit, being for example aligned with a straight line segment oriented parallel to the longitudinal axis of the conduit.

According to one embodiment, the distribution device comprises at least two conduits, a first conduit provided with the inlet opening being surrounded by a second conduit provided with the orifice, the first conduit including at least one passage for the evacuation of the refrigerant fluid from the first conduit to a channel for circulation of the refrigerant fluid formed between the first conduit and the second conduit.

The second conduit surrounds the first conduit at a non-zero distance transversely to the longitudinal axis, producing between them the channel for circulation of the refrigerant fluid. The first conduit and the second conduit are for example coaxial. The passage or passages is or are notably oriented in a direction transverse to the longitudinal axis. The passage or passages is or are notably angularly offset relative to the orifice or orifices, to optimize the path taken by the refrigerant fluid inside the channel. The passages are for example distributed along the first conduit and aligned with a straight line segment parallel to the longitudinal axis and therefore parallel to the straight line segment along which the orifices are aligned. The number of passages and the number of orifices may be the same or different.

The refrigerant fluid evacuated from the first conduit via the passage or passages then circulates inside the channel around the first conduit, prior to its evacuation from the distribution device via the orifice or orifices.

A step of homogenization of the refrigerant fluid between a liquid phase and a gas phase is therefore effected inside the distribution device prior to its evacuation from the distribution device through the orifice or orifices. This improves the homogeneous distribution of the refrigerant fluid between a liquid phase and a gas phase inside the chamber.

According to one embodiment the retaining member comprises a sleeve that receives a second end of the second conduit.

The sleeve is blind on its side oriented toward the exterior of the header, advantageously forming a closure member for the second conduit, at its second end. The sleeve more particularly forms a member for closing the channel formed between the first conduit and the second conduit.

According to one embodiment, the first portion cooperates with a pair of second portions one formed in an end face at the second end of the first conduit and the other formed in an end face at a second end of the second conduit.

The first flange comprises a single rib conjointly accommodated in a first notch that the first conduit includes and in a second notch that the second conduit includes. The first notch and the second notch are oriented in the same direction transverse to the longitudinal axis of the first conduit. The direction of the notches is for example rectilinear.

A second bearing may be formed between the first conduit and the second conduit at their first ends. In other words, the first conduit and the second conduit are also centred relative to one another via the second bearing disposed between them at their first ends. The second bearing may be produced at lower cost by deformation of the wall of the first conduit and/or the second conduit.

For example, the second bearing is formed by moving the first end of the second conduit closer against the first end of the first conduit.

Also for example, the second bearing takes the form of a flange formed at the first end of the first conduit. The flange notably has a diameter greater than that of the first conduit. An exterior face of the flange is in contact with an interior face of the second conduit.

The second bearing advantageously also forms a member for closing the second conduit at its first end. The second bearing more particularly forms, at the first end of the distribution device, a member for closing the channel formed between the first conduit and the second conduit.

According to one embodiment, the sleeve includes a cylindrical part around the distribution device and a flared part that extends the cylindrical part and that is welded around a cylinder that the second flange includes. The sleeve then forms a member for closing an interior space of the chamber formed between the distribution device and the wall of the header and through which it is intended that the refrigerant fluid circulates.

The sleeve can also and advantageously be used to connect the distribution device to a conduit for feeding the refrigerant fluid to the inlet opening. In other words, the sleeve forms a connection interface between a conduit of this kind and the inlet opening that the conduit, notably the first conduit, comprises.

The invention also consists in a heat exchanger equipped with a header according to the invention. The heat exchanger notably comprises tubes of a bundle of tubes that are to be fed with refrigerant fluid from the header.

The wall of the header is composed of a plurality of wall elements assembled to one another, notably including the transverse wall elements, the cover and the header plate. The transverse wall elements extend in a plane parallel to a principal plane in which at least one tube of the heat exchanger lies.

The openings that the header plate includes are notably distributed along the header along the longitudinal axis and/or in the longitudinal direction of the header, each being oriented perpendicularly to the longitudinal axis and/or to the longitudinal direction of the header.

The distribution device is fixed to the wall of the header by welding each of its ends to the transverse wall elements via the retaining member or members and/or the angular positioning member or members. The distribution device is more particularly welded to the wall of the header at its first end via the sleeve and at its second end via the finger and the first portion.

The heat exchanger is more specifically configured to equip a ventilation, heating and/or climate control installation equipping a vehicle, notably a motor vehicle. The heat exchanger can advantageously be used as an evaporator.

The invention finally consists in a method of manufacturing a header as described in the present document, during which:

- the distribution device is installed in the chamber and retained in position relative to the header with the aid of the retaining member,
- optionally, the distribution device is positioned angularly around the longitudinal axis with the aid of the angular position member,
- the distribution device and the wall of the header that delimits the chamber are simultaneously fastened together.

Other features, details and advantages of the present invention will emerge more clearly on reading the description given hereinafter by way of illustrative example, with reference to the drawings of the appended sheets, in which:

FIG. 5 is a perspective view of the header represented in FIGS. 2 to 4, as seen from a second of its longitudinal ends.

FIG. 6 is a partial perspective view of the distribution device represented in FIGS. 2 to 5, as seen from a second of its longitudinal ends.

FIG. 7 is a partial perspective view of the second longitudinal end of the header represented in FIGS. 2 to 6, as seen from inside the header and after removal of the distribution device.

FIG. 8 is a perspective view of the header represented in FIGS. 2 to 7, as seen from a first of its longitudinal ends.

FIG. 9 is a partial exploded perspective view of the first longitudinal end of the header represented in FIG. 8, carrying a first longitudinal end of the distribution device.

It should first be noted that the figures disclose the present invention in detail and in accordance with particular ways of implementing it. Said figures and the detailed descriptions thereof can of course if necessary serve to define the invention better.

Figure 1:
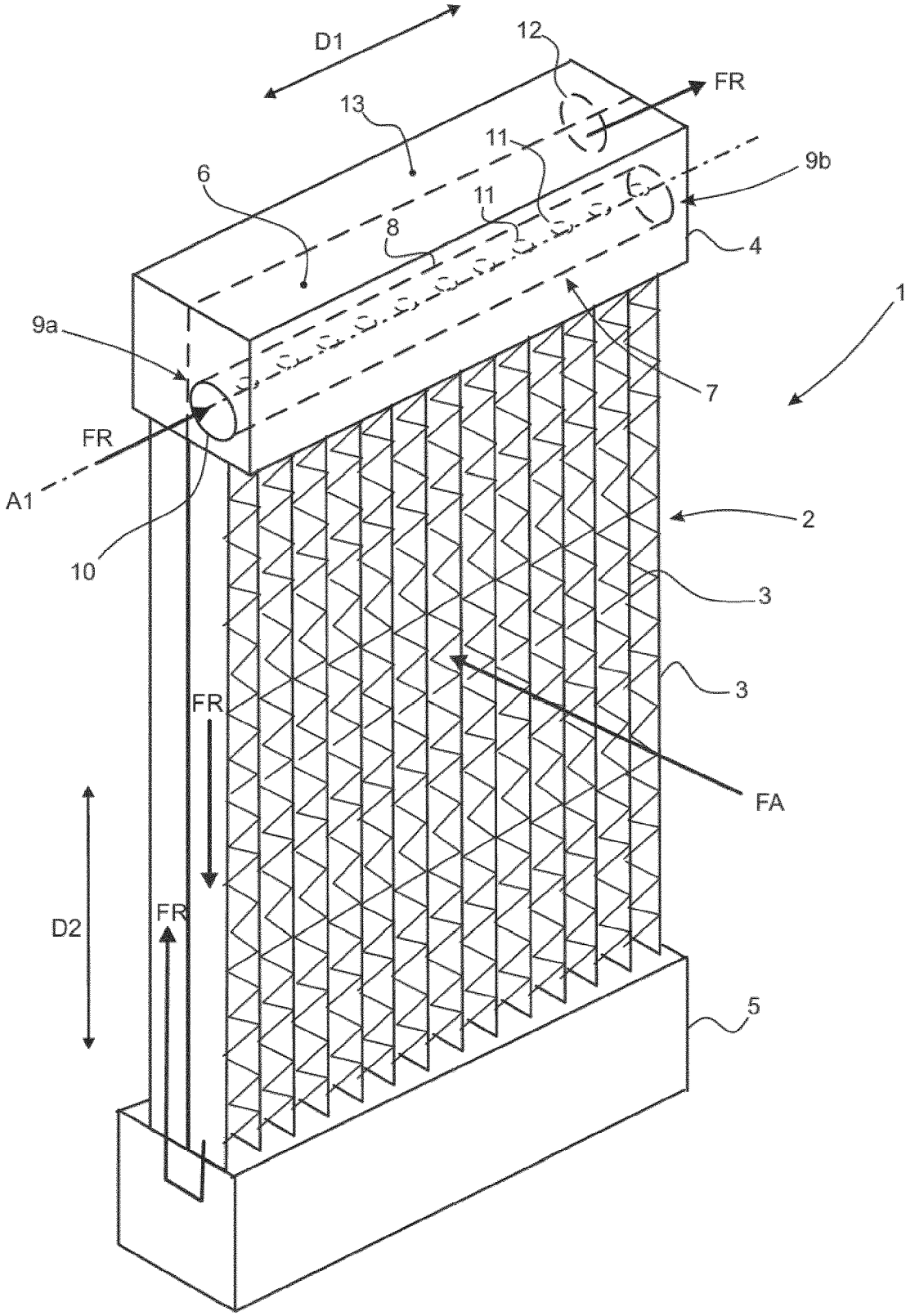
FIG. 1 is a diagrammatic illustration of one embodiment of a heat exchanger comprising a header equipped with a device for distribution of a refrigerant fluid inside the header.

In FIG. 1, a heat exchanger 1 is for example dedicated to cooling a flow of air FA passing through it for heat treating air from the passenger compartment of a vehicle, notably a motor vehicle, or for example to cool a unit of the vehicle in use.

For example, the heat exchanger 1 may be dedicated to cooling a liquid used to cool a unit of the vehicle in use, such as one or more batteries supplying electrical energy to an electric drive train of the vehicle.

The heat exchanger 1 comprises a bundle 2 of tubes 3 disposed between a header 4 and a return box 5. The header 4 extends in a longitudinal direction D1 oriented perpendicularly to a direction D2 in which the tubes 3 extend between the header 4 and the return box 5. The header 4 comprises a wall delimiting a chamber 6 accommodating a device 7 for distribution of a refrigerant fluid FR, for feeding the header 4 with refrigerant fluid FR.

To this end, the distribution device 7 comprises at least one conduit 8 with a longitudinal axis A1 that is for example centred inside the chamber 6. A first longitudinal end 9*a* of the distribution device 7 is provided with an inlet opening 10 for the admission of the refrigerant fluid FR to the interior of the distribution device 7. A second longitudinal end 9*b* of the distribution device 7 is closed.

The conduit 8 includes along the longitudinal axis A1 a plurality of orifices 11 for distributing the refrigerant fluid FR admitted into the distribution device 7 to the chamber 6. The refrigerant fluid FR then circulates inside the chamber 6 to the tubes 3 to cool the flow of air FA, after which it is evacuated from the heat exchanger 1 through an outlet orifice 12.

In the example shown, the outlet orifice 12 discharges into a compartment 13 for evacuation of the refrigerant fluid FR from the heat exchanger 1 that is adjacent to a compartment of the header 4 forming the chamber 6. The heat exchanger 1 is in this case a "U" type circulation heat exchanger. According to a variant, the outlet orifice 12 may be formed through the return box 5. In this case, the heat exchanger 1 is an "I" type circulation heat exchanger.

It will be noted that the invention is applicable to any heat exchanger 1 comprising a header 4 accommodating a distribution device 7 extending at least in part along the longitudinal axis A1 inside the chamber 6. The distribution device 7 can comprise one or more conduits disposed radially around the longitudinal axis.

Figure 2:
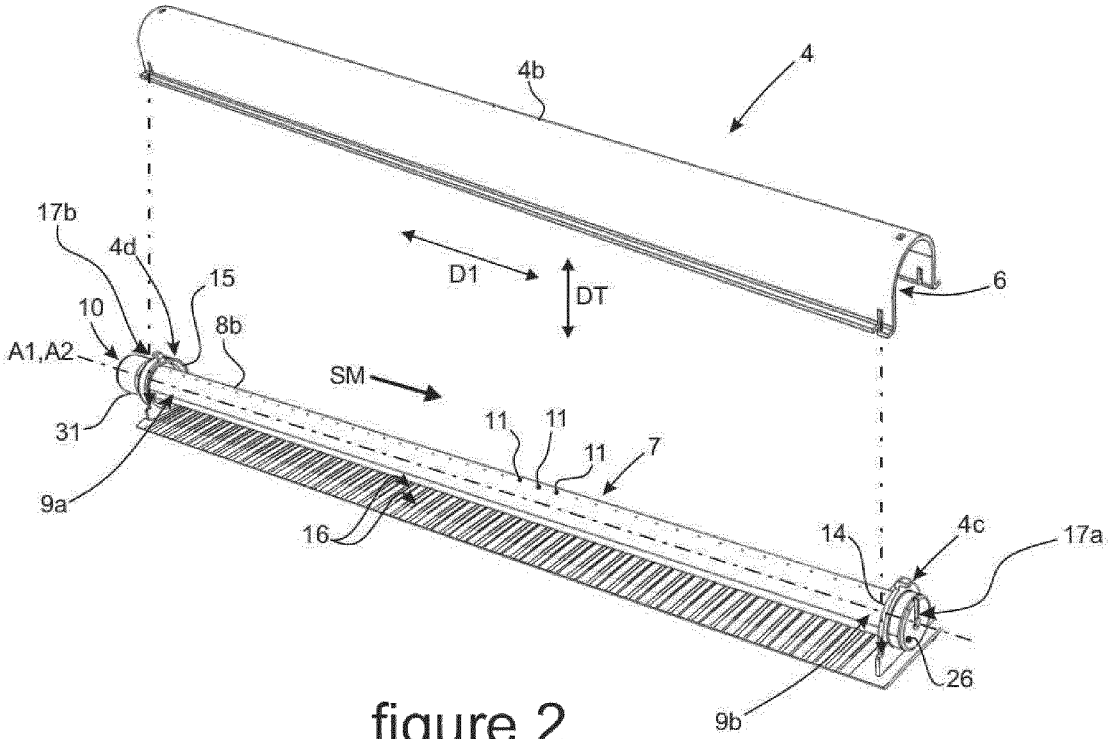
FIG. 2 and FIG. 3 are perspective views of a header accommodating a device for distribution of a refrigerant fluid according to one embodiment of the invention, in partially exploded view in FIG. 2 and assembled in FIG. 3.
Figure 3:
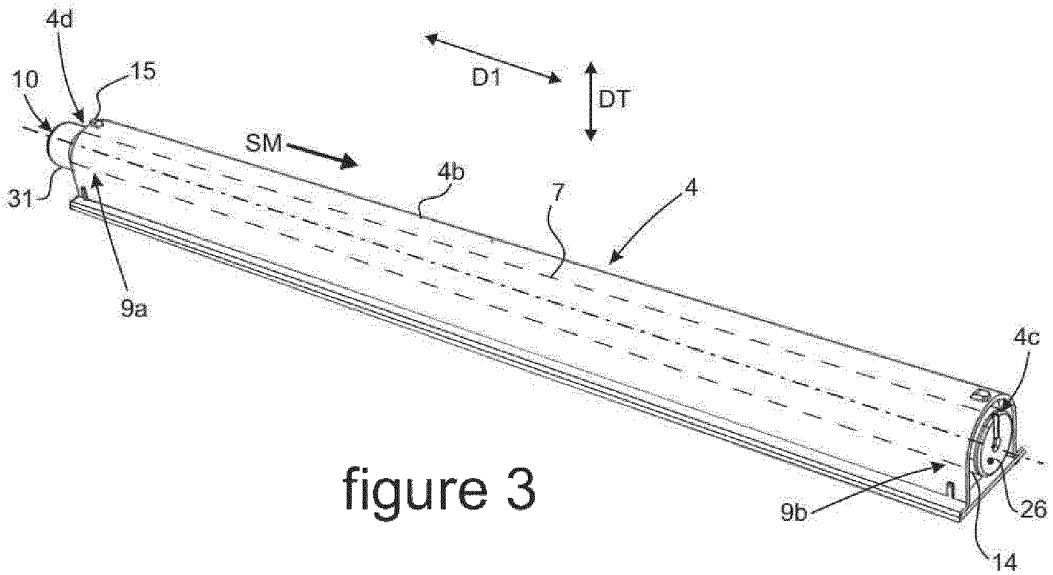
Figure 4:
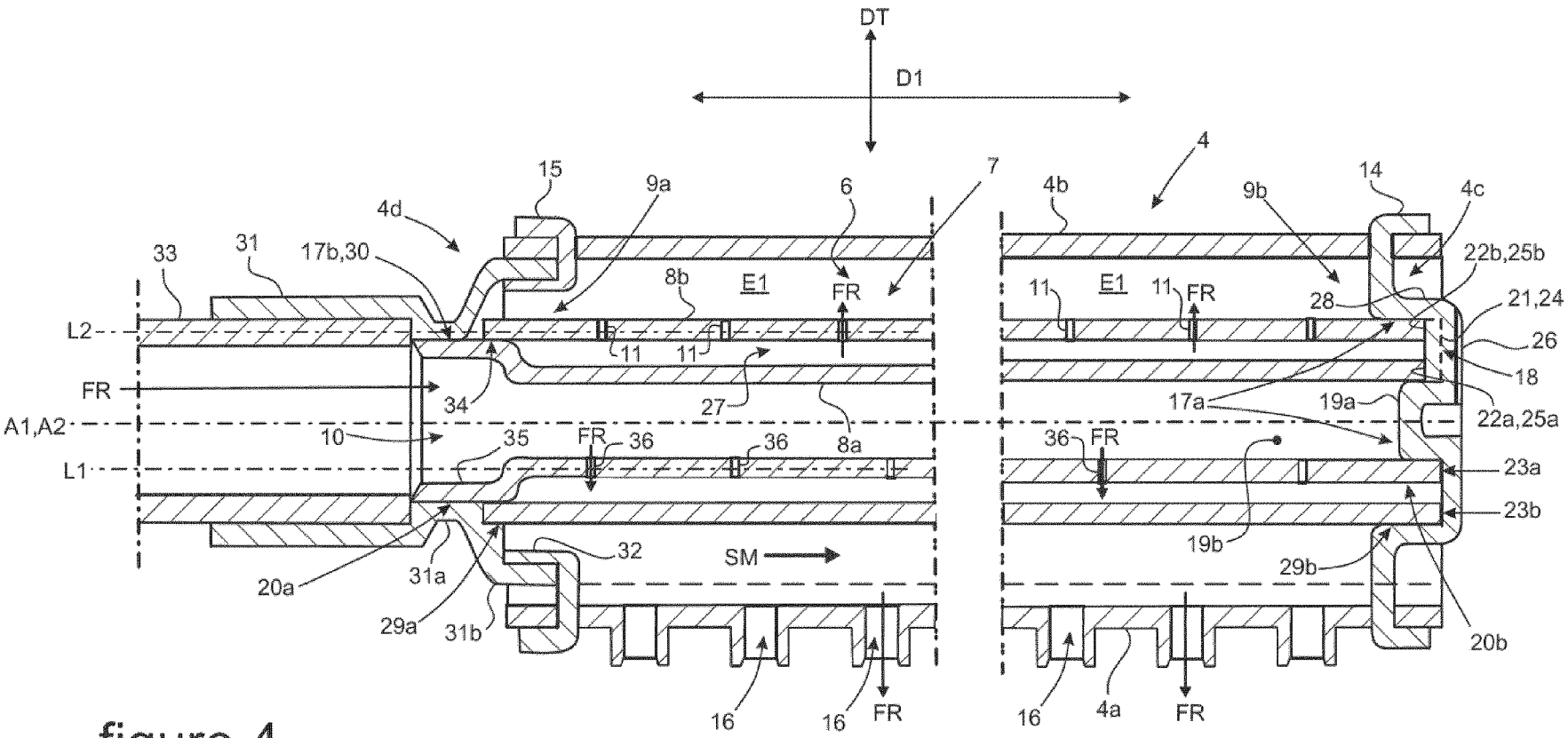
FIG. 4 is a partial view in longitudinal section of the header represented in FIGS. 2 and 3.

In FIGS. 2 to 4, a header 4 according to the invention is configured to equip a heat exchanger, such as the heat exchanger 1 shown for example in FIG. 1. The header 4 comprises a wall comprising wall elements 4*a*-4*d* that delimit between them the chamber 6 that is to receive the distribution device 7 inside the header 4.

According to the embodiment shown, the distribution device 7 extends longitudinally inside the chamber 6 along the longitudinal axis A1, being for example centred on a transversely median axis A2 of the header 4 that extends in the longitudinal direction D1 of the header 4.

The wall elements 4*a*-4*d* constituting the wall of the header 4 are welded to one another and comprise at least one cover 4*b*. These wall elements 4*a*-4*d* may also comprise a header plate 4*a* capped by the cover 4*b*. The header plate 4*a* includes openings 16 for evacuation of the refrigerant fluid FR from the header 4 to the tubes 3 of the heat exchanger 1. Transverse wall elements 4*c*, 4*d* are disposed between the cover 4*b* and the header plate 4*a*, being disposed at the longitudinal ends of the header 4, in its longitudinal direction D1.

The transverse wall elements 4*c*, 4*d* are more particularly formed at least in part by flanges 14, 15 that delimit the chamber 6 in the longitudinal direction D1 of the header 4. The flanges 14, 15 extend between the cover 4*b* and the header plate 4*a*, and in contact therewith, in a transverse direction DT perpendicular to the longitudinal direction D1 of the header 4. The cover 4*b* forms a cap to close the chamber 6 by being welded to the header plate 4*a* and to the flanges 14, 15, which are also welded to the header plate 4*a*.

The distribution device 7 is retained at each of its longitudinal ends 9*a*, 9*b* on the transverse wall elements 4*c*, 4*d* of the header 4 by a retaining member 17*a*, 17*b*, as can be seen in FIGS. 2 to 4 and in accordance with modalities shown in FIGS. 4 to 9. Such retention is effected for example by simultaneous welding with the rest of the components of the header 4, notably the walls 4*a* to 4*d* thereof.

In FIGS. 4 to 9, the distribution device 7 shown by way of example comprises a first conduit 8*a* provided with the inlet opening 10 and surrounded by a second conduit 8*b* provided with the orifices 11. In the example shown, the first conduit 8*a* and the second conduit 8*b* are coaxial. According to a variant the distribution device 7 can comprise a single conduit 8 provided with the inlet opening 10 and the orifices 11.

The distribution device 7 is mechanically retained inside the chamber 6 by means of retaining members 17*a*, 17*b*. The distribution device 7 is angularly positioned by an angular positioning member 18. The retaining members 17*a*, 17*b* and the angular positioning member 18 are each and independently of one another made in one piece with the wall 4*a*-4*d* of the header 4, notably with the transverse wall elements 4*c*, 4*d*. The retaining members 17*a*, 17*b* and/or the angular positioning member 18 are notably formed from the constituent material of the transverse wall elements 4*c*, 4*d*.

Accordingly, the transverse wall elements 4*c*, 4*d* firmly retain the distribution device 7 at each of its longitudinal ends 9*a*, 9*b* by means of the retaining members 17*a*, 17*b* and the angular positioning member 18 that they incorporate. The distribution device 7 is therefore retained at a rigorously controlled position inside the chamber 6 along and/or around the longitudinal axis A1, relative to the longitudinal direction D1 of the header 4.

The transverse wall elements 4*c*, 4*d* more particularly retain the distribution device 7 inside the chamber 6 via each of its longitudinal ends 9*a*, 9*b*. The distribution device 7 is therefore centred on and angularly positioned around the longitudinal axis A1 via the transverse wall elements 4*c*, 4*d*, which for example take the form of flanges 14, 15, as mentioned above. The longitudinal ends 9*a*, 9*b* of the distribution device 7 are configured to be welded to the transverse wall elements 4*c*, 4*d* at least via the retaining members 17*a*, 17*b* and/or the angular positioning member 18. In FIG. 4 and more visible in FIGS. 6 and 7, the second longitudinal end 9*b* of the distribution device 7 is configured to be welded to a first flange 14, via a first retaining member 17*a* and an angular positioning member 18. In FIG. 9, the first longitudinal end 9*a* of the distribution device 7 is configured to be welded to a second flange 15 via a second retaining member 17*b*.

The first flange 14 is a first transverse wall element 4*c* disposed at the second end 9*b* of the distribution device 7. The second flange 15 is a second transverse wall element 4*d* disposed at the first end 9*a* of the distribution device 7. It will be noted that the first flange 14 forms a member for closing the distribution device 7 at its second longitudinal end 9*b*.

When the first retaining member 17*a* is a centring member, the distribution device 7 is then centred and optionally angularly positioned on the first flange 14 via its second longitudinal end 9*b*. The distribution device 7 is also centred on the second flange 15 via cooperation between its first longitudinal end 9*a* and the second retaining member 17*b*, the latter then being a member for centring the distribution device in the chamber 6 of the header 4.

The distribution device 7 can be welded to the flanges 14, 15 at the same time as welding together the wall elements 4*a*-4*d* constituting the wall of the header 4 and/or at the same time as welding the tubes 3 of the heat exchanger 1 to the header plate 4*a*.

In FIG. 7, the first retaining member 17*a* comprises a finger 19*a* configured to be accommodated inside an opening 19*b* of the first conduit 8*a*. The finger 19*a* is centred on the transversely median axis A2 of the header 4 and on the longitudinal axis A1 of the distribution device 7. The distribution device 7 is therefore retained at least by the finger 19*a* nesting inside the opening 19*b* of the first conduit 8*a*.

Moreover, the finger 19*a* advantageously forms a plug for closing the first conduit 8*a* at its opposite second end 20*b*, along the longitudinal axis A1, its first end 20*a* provided with the inlet opening 10, to force the evacuation of the refrigerant fluid from the first conduit 8*a* via the passages 36 that it includes.

The angular positioning member 18 is configured with a first portion 21 formed on the first flange 14 as shown in FIG. 7. The first portion 21 cooperates through complementarity of shapes with at least one second portion 22*a*, 22*b* formed in an end face 23*a*, 23*b* of the first conduit 8*a* and/or the second conduit 8*b*, as shown in FIG. 6. The first portion 21 and the second portion or portions 22*a*, 22*b* extend in the transverse direction DT, or in other words radially relative to the longitudinal axis A1 and/or to the transversely median axis A2 of the header 4. The distribution device 7 is therefore angularly immobilized at a predefined position on the transverse wall 4*c* formed for example by the first flange 14.

The first portion 21 is notably configured as a rib 24 extending the finger 19*a* perpendicularly to the longitudinal axis A1 or in other words in the transverse direction DT. The second portions 22*a*, 22*b* are notably configured as at least one first notch 25*a* formed on the end face 23*a* of the first conduit 8*a* and/or a second notch 25*b* formed on the end face 23*b* of the second conduit 8*b*, as is clear from FIG. 6. Alternatively, at least one rib may be formed at the end of the distribution device 7 and at least one notch may be formed on the first flange 4*c*.

The finger 19*a* and the rib 24 are formed during an operation of shaping the first flange 4*c*, such as by drawing or by casting, for example. The finger 19*a* and the rib 24 are made from the material 26 constituting the first flange 14.

According to the embodiment of the distribution device 7 shown, the first conduit 8*a* is surrounded, at a non-zero transverse distance, by the second conduit 8*b* to form between them a channel 27 for circulation of the refrigerant fluid FR, prior to its evacuation from the distribution device 7 via the orifices 11. In a situation of this kind, the first retaining member 17*a* then comprises a sleeve 28 formed by the wall 26 of the first flange 4*c*.

The sleeve 28 accommodates a second end 29*b* of the opposite second conduit 8*b*, along the longitudinal axis A1, at its first end 29*a* close to the first end 20*a* of the first conduit 8*a*. The first conduit 8*a* and the second conduit 8*b* are thus centred along the longitudinal axis A1 relative to one another at the second end 9*b* of the distribution device 7. The first retaining member 17*a* can thus become a member for centring the second conduit 8*b* relative to the first conduit 8*a*.

The distribution device 7 is therefore retained, possibly centred, on the wall 4*a*-4*d* of the header 4 at its second longitudinal end 9*b* via the finger 19*a* accommodated in the opening 19*b* of the first conduit 8*a* and/or via the sleeve 28 receiving the second conduit 8*b*.

The first flange 14 then forms the member for closing the distribution device 7 at its second longitudinal end 9*b*. The first flange 14 incorporating the first retaining member 17*a* and the angular positioning member 18 then more particularly closes the channel 27 at the second longitudinal end 9*b* of the distribution device 7.

In FIG. 4 and in FIG. 9, the second retaining member 17*b* comprises a first bearing 30 supporting the first end 9*a* of the distribution device 7 via the second conduit 8*b* for example. The first bearing 30 is formed in a sleeve 31 welded to the second flange 15.

The sleeve 31 is welded to the second flange 15 on its side oriented toward the outside of the header 4. The sleeve 31 includes a cylindrical part 31*a* that forms the first bearing 30 of the distribution device 7. The cylindrical part 31*a* of the sleeve 31 is extended by a flared part 31*b* welded around a cylinder 32 that the second flange 15 includes and that surrounds at a transverse distance the distribution device 7. The sleeve 31 is therefore centred on the transversely median axis A2 of the header 4 and on the longitudinal axis A1.

As can notably be seen in FIG. 4, the sleeve 31 then forms a member for closing a space E1 formed inside the chamber 6 around the distribution device 7. The space E1 is delimited between the wall 4*a*-4*d* of the header 4 and the distribution device 7, occupying the interior volume of the header 4 around the distribution device 7.

The space E1 therefore forms a path for circulation of the refrigerant fluid FR evacuated from the distribution device 7 to the openings 16 in the header plate 4*a*. The refrigerant fluid is then evacuated from the header 4 to feed with refrigerant fluid FR the tubes 3 of the heat exchanger 1.

The sleeve 31 also forms a fluidic connection interface between the distribution device 7 and a conduit 33 for feeding the refrigerant fluid FR to the inlet opening 10. The refrigerant fluid FR fed by the conduit 33 therefore flows toward the inlet opening 10 of the distribution device 7, to feed it with refrigerant fluid FR.

Moreover, the first conduit 8*a* and the second conduit 8*b* are centred relative to one another at their first end 20*a*, 29*a* via a second bearing 34 formed between them. To this end, the first conduit 8*a* includes at its first end 20*a* a flange 35 in contact with an interior face of the second conduit 8*b*, at its first end 29*a*. An exterior peripheral face of the flange 35 is therefore welded to the interior face of the second conduit 8*b*.

The second bearing 34 also forms a member for closing the distribution device 7 at its first end 9*a*. To be more specific, the second bearing 34 forms a member for closing the channel 27 at the first end 9*a* of the distribution device 7. The channel 27 is thus closed at each of the longitudinal ends 9*a*, 9*b* of the distribution device 7 by the second bearing 34 on the one hand and by the first flange 14 on the other hand.

The retention of the distribution device 7 in position on the wall 4*a*-4*d* of the header 4 is achieved rigorously without impeding rapid and easy mounting of the distribution device 7 inside the chamber 6. The distribution device 7 can be threaded in a mounting direction SM parallel to the transversely median axis A2 of the header 4.

In the mounting direction SM, the distribution device 7 is threaded from its second end 9*b* through the second flange 15, and then slides in the mounting direction SM toward the first flange 14. The distribution device 7 can therefore slide inside the chamber 6 until its second end 9*b* is placed inside the first flange 14.

At the end of the sliding of the distribution device 7 inside the chamber 6, the second end 29*b* of the second conduit 8*b* is introduced into the sleeve 28, the finger 19*a* is introduced into the first conduit 8*a* and the rib 24 is introduced into the first notch 25*a* and the second notch 25*b*. Accordingly, after mounting the distribution device 7 by sliding it on the wall 4*a*-4*d* of the header 4, the distribution device 7 is retained, or even centred, at each of its ends 9*a*, 9*b* and/or angularly positioned at its second end 9*b* on the transverse wall elements 4*c*, 4*d* that the wall 4*a*-4*d* of the header 4 comprises. A structure of this kind advantageously enables prepositioning of the components of the header 4, guaranteeing absence of movement prior to their simultaneous brazing in an appropriate furnace.

In FIGS. 4 and 6, the first conduit 8*a* includes the passages 36 through which the refrigerant fluid FR admitted to the interior of the first conduit 8*a* can be evacuated to the channel 27. The passages 36 are aligned on a first straight line segment L1 and the orifices 11 formed in the second conduit 8*b* are aligned on a second straight line segment L2.

The first straight line segment L1 and the second straight line segment L2 may be parallel to one another and to the longitudinal axis A1, being angularly offset relative to one another about the longitudinal axis A1. In the example shown, the first straight line segment L1 and the second straight line segment L2 are angularly offset by 180 degrees, being disposed on respective opposite sides of the longitudinal axis A1 in the transverse direction DT, the passages 36 opening substantially facing the openings 16 whereas the orifices 11 open substantially toward the cover 4*b* of the header 4. In FIG. 4, the refrigerant fluid FR fed by the conduit 33 is admitted to the interior of the first conduit 8*a* through the inlet opening 10, and is then evacuated from the first conduit 8*a* via the passages 36 to the channel 27. The refrigerant fluid FR then circulates inside the channel 27 around the first conduit 8*a*, prior to its evacuation from the distribution device 7 via the orifices 11 to the space E1 formed inside the chamber 6. The refrigerant fluid FR sprayed from the distribution device 7 then circulates around the distribution device 7 to the openings 16 that the header plate 4*a* includes, to feed each of the tubes 3 of the heat exchanger 1 with refrigerant fluid FR.

According to the example shown, the refrigerant fluid FR is sprayed from the distribution device 7 inside the chamber 6 transversely opposite the openings 16 in the header plate 4*a*, relative to the longitudinal axis A1. The path followed by the refrigerant fluid FR inside the space E1 to the openings 16 in the header plate 4*a* is therefore optimized. The circulation of the refrigerant fluid FR inside the channel 27 and/or inside the space E1 encourages its mixing between a liquid phase and a gas phase, prior to its distribution to the tubes 3 of the heat exchanger 1 via the openings 16 in the header plate 4*a*.

The header 4 is fabricated in the following manner: the distribution device 7 is installed in the chamber 6, for example by sliding it longitudinally, and retained in position relative to the header 4 with the aid of the retaining member 17*a*, 17*b*, optionally, the distribution device 7 is positioned angularly around the longitudinal axis A1 with the aid of the angular position member 18, for example by rotating the distribution device 7 until the rib is inserted into the notch or notches, the distribution device 7 and the wall 4*a*-4*d* of the header 4 that delimits the chamber 6 are simultaneously fastened together, for example by brazing in a furnace.

The heat exchanger 1 obtained offers particularly high performance at lower cost, notably thanks to the rigorous and reliable retention in position of the distribution device 7 on the wall 4*a*-4*d* of the header 4 and/or thanks to the optimization achieved of the mixture of the refrigerant fluid FR between a liquid phase and a gas phase, prior to its distribution from the header 4 to the tubes 3 of the heat exchanger 1.

The invention claimed is:

1. A header for a heat exchanger adapted to have a refrigerant fluid passed through it and comprising:

a wall delimiting a chamber accommodating a distribution device for distribution of the refrigerant fluid inside the chamber, wherein the chamber and the distribution device are coaxial along a longitudinal axis centered on a transversely median axis of the header that extends in a longitudinal direction of the header, the distribution device comprising at least one conduit extending between two ends along the longitudinal axis, at least a first end of the conduit being provided with an inlet opening for the admission of the refrigerant fluid to the interior of the distribution device, the distribution device being provided with at least one orifice oriented transversely to the longitudinal axis for the evacuation of the refrigerant fluid from the distribution device to the chamber; and at least one member for retaining the distribution device inside the chamber at least in part made in one piece with the wall of the header, wherein the retaining member comprises at least one finger made in one piece with the wall of the header and an opening delimited by the conduit, the at least one finger being accommodated in the opening and centered on the longitudinal axis to form a plug in the opening, wherein the wall of the header comprises at least one cover, wherein a cross-section of the at least one cover has a profile in a shape of a semi-circle extending a full length of the at least one cover, and wherein the at least one cover extends along the longitudinal axis, wherein at least one flange is disposed at a longitudinal end of the cover and the at least one flange is oriented transversely to the longitudinal axis, and wherein the at least one cover comprises an opening to receive a notch of the at least one flange.

2. The header according to claim 1, comprising at least one member for angular positioning of the distribution device inside the chamber at least in part made in one piece with the wall of the header.

3. The header according to claim 2, wherein the retaining member and/or the angular positioning member is at least in part made in one piece with the flange.

4. The header according to claim 3, wherein the flange forms a plug for closing the distribution device at one longitudinal end of the conduit, termed the second end, opposite the first end of the conduit along the longitudinal axis.

5. The header according to claim 2, wherein the angular positioning member comprises at least two portions of complementary shape to one another, a first portion made in one piece with the wall of the header cooperating by nesting with a second portion formed in an end face at one of the longitudinal ends of the conduit.

6. The header according to claim 5, wherein the distribution device comprises at least two conduits, a first conduit provided with the inlet opening being surrounded by a second conduit provided with the orifice, the first conduit including at least one passage for the evacuation of the refrigerant fluid from the first conduit to a channel for circulation of the refrigerant fluid formed between the first conduit and the second conduit.

7. The header according to claim 6, wherein the retaining member comprises a sleeve that receives a second end of the second conduit.

8. The header according to claim 6, wherein the first portion cooperates with a pair of second portions one formed in an end face at the second end of the first conduit and the other formed in an end face at a second end of the second conduit.

9. A method of manufacturing the header according to claim 1, the method comprising:

installing and retaining the distribution device in the chamber and in position relative to the header with the aid of the retaining member;

positioning the distribution device angularly around the longitudinal axis with the aid of the angular position member; and simultaneously fastening the distribution device and the wall of the header that delimits the chamber together.

10. A heat exchanger equipped with a header configured to allow a refrigerant fluid pass through it, the header comprising:

a wall delimiting a chamber accommodating a distribution device for distribution of the refrigerant fluid inside the chamber, wherein the chamber and the distribution device are coaxial along a longitudinal axis centered on a transversely median axis of the header that extends in a longitudinal direction of the header, the distribution device comprising at least one conduit extending between two ends along the longitudinal axis, at least a first end of the conduit being provided with an inlet opening for the admission of the refrigerant fluid to the interior of the distribution device, the distribution device being provided with at least one orifice oriented transversely to the longitudinal axis for the evacuation of the refrigerant fluid from the distribution device to the chamber; and at least one member for retaining the distribution device inside the chamber at least in part made in one piece with the wall of the header, wherein the retaining member comprises at least one finger made in one piece with the wall of the header and an opening delimited by the conduit, the at least one finger being accommodated in the opening to form a plug in the opening, wherein the wall of the header comprises at least one cover, wherein a cross-section of the at least one cover has a profile in a shape of a semi-circle extending a full length of the at least one cover, and wherein the at least one cover extends along the longitudinal axis, wherein at least one flange is disposed at a longitudinal end of the cover and the at least one flange is oriented transversely to the longitudinal axis, and wherein the at least one cover comprises an opening to receive a notch of the at least one flange.

* * * * *